US009284954B2

(12) United States Patent
Yamamoto et al.

(10) Patent No.: US 9,284,954 B2
(45) Date of Patent: Mar. 15, 2016

(54) VARIABLE DISPLACEMENT SWASH PLATE TYPE COMPRESSOR

(71) Applicant: KABUSHIKI KAISHA TOYOTA JIDOSHOKKI, Aichi-ken (JP)

(72) Inventors: Shinya Yamamoto, Aichi-ken (JP); Takahiro Suzuki, Aichi-ken (JP); Kazunari Honda, Aichi-ken (JP); Kei Nishii, Aichi-ken (JP); Yusuke Yamazaki, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 42 days.

(21) Appl. No.: 14/304,398

(22) Filed: Jun. 13, 2014

(65) Prior Publication Data

US 2014/0377088 A1 Dec. 25, 2014

(30) Foreign Application Priority Data

Jun. 20, 2013 (JP) ..... 2013-129901

(51) Int. Cl.
*F04B 27/10* (2006.01)
*F04B 27/12* (2006.01)
*F04B 27/16* (2006.01)
(Continued)

(52) U.S. Cl.
CPC ..... *F04B 27/086* (2013.01); *F04B 27/1054* (2013.01); *F04B 27/1072* (2013.01); *F04B 27/12* (2013.01); *F04B 27/18* (2013.01); *F04B 27/1804* (2013.01); *F04B 2027/1813* (2013.01)

(58) Field of Classification Search
CPC ..... F04B 27/10; F04B 27/12; F04B 27/14; F04B 27/16; F04B 27/18; F04B 27/1054; F04B 27/1804; F04B 2027/1813; F04B 2027/1822; F04B 2027/1831
USPC ..... 417/222.1, 222.2, 269, 270
See application file for complete search history.

(56) References Cited

U.S. PATENT DOCUMENTS 4,061,443 A * 12/1977 Black ..... F04B 27/1072 184/6.17
4,174,191 A * 11/1979 Roberts ..... F04B 27/18 417/222.1
4,297,085 A * 10/1981 Brucken ..... F04B 27/1054 417/222.1
(Continued)

FOREIGN PATENT DOCUMENTS

EP 0550228 7/1993
JP 01-219364 9/1989
(Continued)

OTHER PUBLICATIONS

Search Report for E.P.O., dated Jul. 13, 2015.

*Primary Examiner* — Peter J Bertheaud
(74) *Attorney, Agent, or Firm* — Greenblum & Bernstein, P.L.C.

(57) ABSTRACT

A variable displacement swash plate type compressor having high controllability and capable of exhibiting high mounting performance and securing sufficient compression capacity is provided. The compressor of the present invention comprises a first cylinder block and a second cylinder block, and an actuator. The actuator includes an actuator main body and a control pressure chamber. A first cylinder bore and a first storage chamber are formed in the first cylinder block. A second cylinder bore and a second storage chamber are formed in the second cylinder block. The first cylinder bore is formed to have a diameter smaller than the diameter of the second cylinder bore.

9 Claims, 6 Drawing Sheets

(51) Int. Cl.
*F04B 27/18* (2006.01)
*F04B 27/08* (2006.01)

(56) References Cited

U.S. PATENT DOCUMENTS 4,963,074 A * 10/1990 Sanuki ..... F04B 27/18 417/222.1
5,022,826 A * 6/1991 Matsuda ..... F04B 27/12 417/222.1
5,032,060 A * 7/1991 Kobayashi ..... F04B 27/12 417/222.1
5,252,032 A * 10/1993 Iwanami ..... F04B 27/18 417/222.1
5,259,736 A * 11/1993 Terauchi ..... F01B 3/106 417/222.1
5,370,503 A * 12/1994 Terauchi ..... F04B 27/1072 417/222.2
5,547,346 A * 8/1996 Kanzaki ..... F04B 49/022 417/222.2
5,772,407 A * 6/1998 Kato ..... F04B 27/109 184/6.16
5,921,756 A * 7/1999 Matsuda ..... F04B 27/12 417/269
6,142,745 A * 11/2000 Kawaguchi ..... F04B 27/1804 417/222.2

FOREIGN PATENT DOCUMENTS

JP 04-094470 3/1992
JP 04-191472 7/1992
JP 5-26171 2/1993
JP 05-172052 7/1993

* cited by examiner

VARIABLE DISPLACEMENT SWASH PLATE TYPE COMPRESSOR

TECHNICAL FIELD

The present invention relates to a variable displacement swash plate type compressor.

BACKGROUND ART

A conventional variable displacement swash plate type compressor (hereinafter referred to as compressor) is disclosed in Japanese Patent Laid-Open No. 5-172052. In the compressor, a housing is formed by a front housing, a cylinder block, and a rear housing. A suction chamber and a discharge chamber are formed in the front housing and the rear housing, respectively. Further, a pressure regulation chamber is formed in the rear housing.

A swash plate chamber and a plurality of cylinder bores are formed in the cylinder block. Each of the cylinder bores is configured by a first cylinder bore formed on the rear side of the cylinder block, and a second cylinder bore formed on the front side of the cylinder block. Each of the first cylinder bores and the second cylinder bores has the same diameter.

A drive shaft is inserted in the housing and is supported rotatably in the cylinder block. A swash plate, which can be rotated by rotation of the drive shaft, is provided in the swash plate chamber. A link mechanism, which allows the inclination angle of the swash plate to be changed, is provided between the drive shaft and the swash plate. Here, the inclination angle means an angle formed by the swash plate with respect to the direction perpendicular to the rotational axis of the drive shaft.

Further, a piston is accommodated so as to be able to reciprocate in each of the cylinder bores. Specifically, each of the pistons includes a first head section reciprocating in each of the first cylinder bores, and a second head section reciprocating in each of the second cylinder bores. Since each of the first cylinder bores and the second cylinder bores of the cylinder bores has the same diameter, each of the first head sections and the second head sections of the pistons also have the same diameter. Thereby, in this compressor, first compression chambers are formed by each of the first cylinder bores and each of the first head sections, and second compression chambers are formed by each of the second cylinder bores and each of the second head sections. A conversion mechanism is configured such that, by rotation of the swash plate, each of the pistons is reciprocated in each of the cylinder bores at a stroke corresponding to the inclination angle of the swash plate. Further, the inclination angle can be changed by an actuator, and a control mechanism is configured to control the actuator.

In the swash plate chamber, the actuator is arranged on the side of the first cylinder bores with respect to the swash plate. The actuator includes an actuator main body and a control pressure chamber. The actuator main body includes a non-rotating movable body, a movable body, and a thrust bearing. The non-rotating movable body is arranged in the control pressure chamber so as not to be rotatable integrally with the drive shaft and covers a rear end portion of the drive shaft. The inner peripheral surface of the non-rotating movable body is configured to rotatably slidably support the rear end portion of the drive shaft, and is configured to be able to move in the direction of the rotational axis. Further, the outer peripheral surface of the non-rotating movable body is configured to slide in the direction of the rotational axis in the control pressure chamber, and is configured not to slide around the rotational axis. The movable body is connected to the swash plate so as to be movable in the direction of the rotational axis. The thrust bearing is provided between the non-rotating movable body and the movable body.

The control pressure chamber is provided on the rear side of the cylinder block, that is, on the side of the first cylinder bores in the cylinder block. A pressing spring, which urges the non-rotating movable body toward the front side, is provided in the control pressure chamber. Further, a pressure control valve, which changes the pressure in the control pressure chamber so as to enable the non-rotating movable body and the movable body to move in the direction of the rotational axis, is provided between the pressure regulation chamber and a discharge chamber.

The link mechanism is arranged so that, according to a change of the inclination angle of the swash plate, the top dead center position of the second head section of each of the pistons is moved more than the top dead center position of the first head section of each of the pistons. The link mechanism includes a movable body and a lug arm fixed to the drive shaft. A long hole, which extends in the direction perpendicular to the rotational axis and in the direction approaching the rotational axis from the outer peripheral side, is formed at the rear end portion of the lug arm. The swash plate is supported pivotably around a first pivotal axis by a pin inserted into the long hole on the front side of the swash plate. Further, a long hole, which extends in the direction perpendicular to the rotational axis and in the direction approaching the rotational axis from the outer peripheral side, is also formed at the front end portion of the movable body. The swash plate is supported pivotably around a second pivotal axis in parallel with the first pivotal axis by a pin inserted into the long hole at the rear end of the swash plate.

In this compressor, when the pressure regulation valve is controlled to be opened so that the discharge chamber communicates with the pressure regulation chamber, the pressure in the control pressure chamber is made higher than the pressure in the swash plate chamber. Thereby, the non-rotating movable body and the movable body are moved toward the front side. By this movement, the inclination angle of the swash plate is increased, so that the strokes of the pistons are increased. Thereby, the compression capacity per one revolution of the compressor is increased. When the pressure regulation valve is controlled to be closed so that the discharge chamber does not communicate with the pressure regulation chamber, the pressure in the control pressure chamber is reduced to almost the same pressure as that in the swash plate chamber. Thereby, the non-rotating movable body and the movable body are moved toward the rear side. By this movement, the inclination angle of the swash plate is reduced, so that the strokes of the pistons are reduced. As a result, the compression capacity per one revolution of the compressor is reduced.

Here, in each of the pistons of this compressor, the top dead center position of the second head section of the piston is moved more largely than the top dead center position of the first head section of the piston. Therefore, when the inclination angle of the swash plate is made close to 0 degree, a slight amount of compression work is performed only in the first compression chambers, and no compression work is performed in the second compression chambers.

Meanwhile, in a compressor, high controllability is required in order that the compression capacity can be rapidly increased or reduced according to an operation condition of a vehicle, or the like, to which the compressor is mounted. To cope with this requirement, also in the above-described conventional compressor, it is considered to increase the size of the control pressure chamber of the actuator. Therefore, it is considered that, in the compressor, the inclination angle of the swash plate is rapidly changed by sliding the non-rotating movable body and the movable body in the direction of the rotational axis with a large thrust force.

However, in this compressor, the control pressure chamber is formed in the cylinder block. Therefore, when the size of the control pressure chamber is increased, the size of the cylinder block is increased, so that the entire size of the compressor is increased. As a result, the mounting performance of the compressor to a vehicle, or the like, is lowered.

In this compressor, when the diameter of the cylinder bores is reduced to increase the size of the control pressure chamber of the actuator, desired compression capacity cannot be secured.

The present invention has been made in view of the above described circumstances. An object of the present invention is to provide a variable displacement swash plate type compressor which has high controllability and which can exhibit high mounting performance and secure sufficient compression capacity.

SUMMARY OF THE INVENTION

A variable displacement swash plate type compressor according to the present invention comprises:

a housing in which a suction chamber, a discharge chamber, a swash plate chamber, and a cylinder bore are formed; a drive shaft which is rotatably supported by the housing; a swash plate capable of rotating in the swash plate chamber by rotation of the drive shaft; a link mechanism which is provided between the drive shaft and the swash plate to allow a change of the inclination angle of the swash plate with respect to the direction perpendicular to the rotational axis of the drive shaft; a piston which is accommodated in the cylinder bore so as to be able to reciprocate in the cylinder bore; a conversion mechanism which reciprocates the piston in the cylinder bore by rotation of the swash plate and at a stroke corresponding to the inclination angle; an actuator capable of changing the inclination angle; and a control mechanism which controls the actuator, wherein the cylinder bore is configured by a first cylinder bore provided on one surface side of the swash plate, and a second cylinder bore provided on the other surface side of the swash plate, the piston includes a first head section being reciprocated in the first cylinder bore and partitioning a first compression chamber in the first cylinder bore, and a second head section being reciprocated in the second cylinder bore and partitioning a second compression chamber in the second cylinder bore, the link mechanism is arranged to allow the top dead center position of the first head section to be moved more than the top dead center position of the second head section according to a change of the inclination angle, the actuator is provided to be rotatable integrally with the drive shaft and is arranged on the side of the first cylinder bore with respect to the swash plate in the swash plate chamber, the actuator includes an actuator main body connected to the swash plate and configured to be movable in the rotational axis direction, and a control pressure chamber configured to move the actuator main body at the time when the internal pressure of the control pressure chamber is changed by the control mechanism, and the first cylinder bore is formed to have a diameter smaller than the diameter of the second cylinder bore.

DETAILED DESCRIPTION OF EXEMPLARY EMBODIMENTS

In the following, Embodiments 1 to 4 exemplifying the present invention will be described with reference to the accompanying drawings. The compressor of each of Embodiments 1 to 4 is a variable displacement swash plate type compressor. Each of the compressors is mounted to a vehicle so as to configure a refrigeration circuit of a vehicle air conditioner.

[Embodiment 1]

Figure 1:
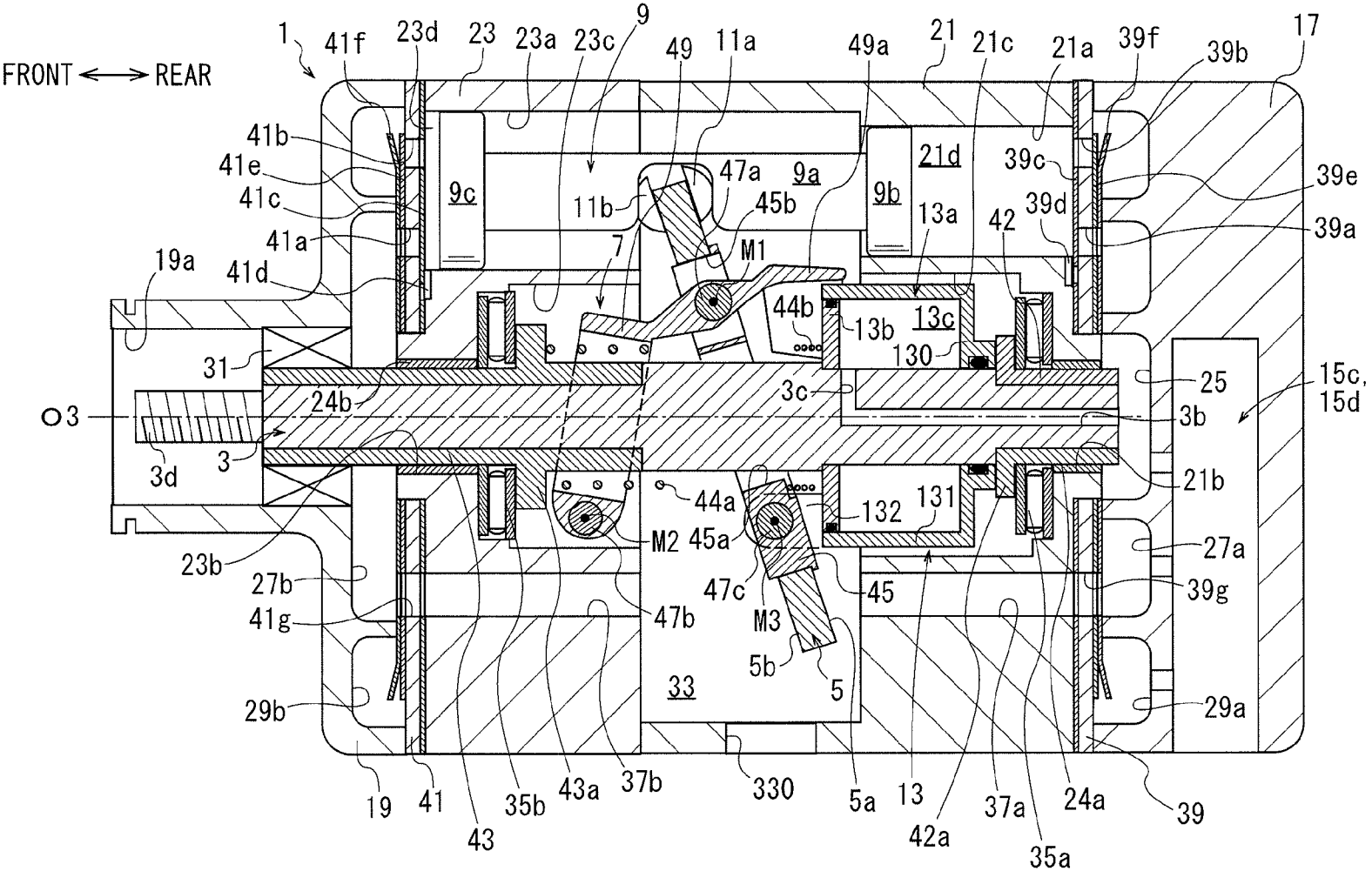
FIG. 1 is a cross-sectional view at the time of maximum capacity in a compressor of Embodiment 1.
Figure 2:
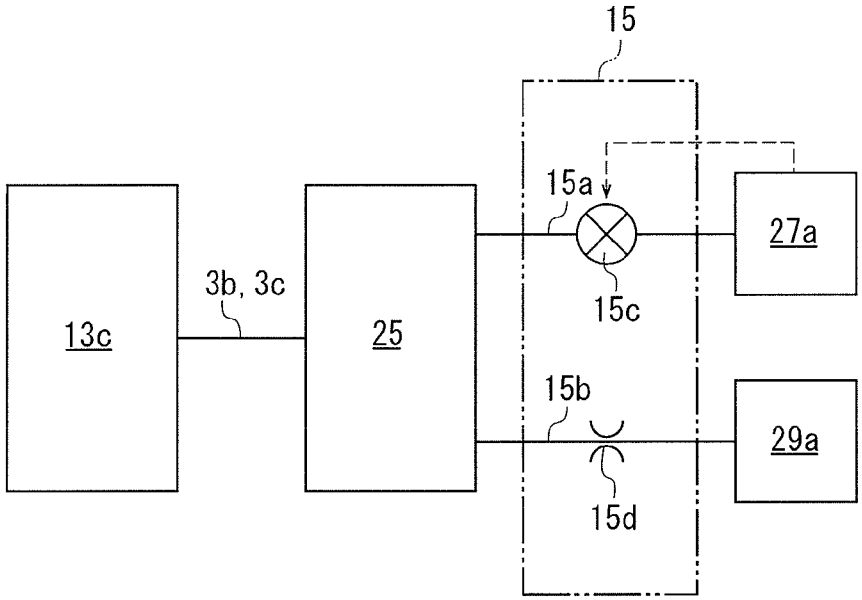
FIG. 2 is a schematic view showing a control mechanism according to the compressor of Embodiment 1.

As shown in FIG. 1, a compressor of Embodiment 1 comprises a housing 1, a drive shaft 3, a swash plate 5, a link mechanism 7, a plurality of pistons 9, a plurality of pairs of shoes 11*a* and 11*b*, an actuator 13, and a control mechanism 15 shown in FIG. 2.

As shown in FIG. 1, the housing 1 includes a rear housing 17, a front housing 19, a first cylinder block 21, and a second cylinder block 23.

The rear housing 17 is arranged on the rear side of the compressor. The above-described control mechanism 15 is provided in the rear housing 17. Further, a pressure regulation chamber 25, a first suction chamber 27*a*, and a first discharge chamber 29*a* are formed in the rear housing 17. The pressure regulation chamber 25 is located at a center portion of the rear housing 17. The first discharge chamber 29*a* is located on the outer peripheral side of the rear housing 17. Further, the first suction chamber 27*a* is formed between the pressure regulation chamber 25 and the first discharge chamber 29*a* in the rear housing 17. That is, the first suction chamber 27*a* is formed at a position on the outer peripheral side from the pressure regulation chamber 25 and on the inner peripheral side from the first discharge chamber 29*a*.

A boss 19*a* projected toward the front side is formed at the front housing 19. In the boss 19*a*, a shaft seal device 31 is provided between the inner surface of the boss 19*a* and the drive shaft 3, more specifically, between the inner surface of the boss 19*a* and a second support member 43 described below. Further, a second suction chamber 27*b* and a second discharge chamber 29*b* are formed in the front housing 19. The second suction chamber 27*b* is located on the inner peripheral side of the front housing 19, and the second discharge chamber 29*b* is located on the outer peripheral side of the front housing 19. Further, the second discharge chamber 29*b* and the first discharge chamber 29*a* are connected to each other by a discharge passage (not shown). A outlet port (not shown) is formed in the discharge passage so as to communicate with the outside of the compressor.

The first cylinder block 21 and the second cylinder block 23 are located between the rear housing 17 and the front housing 19, so as to be adjacent to each other. Further, the first cylinder block 21 is located on the rear side of the compressor, so as to be adjacent to the rear housing 17. The second cylinder block 23 is located on the front side of the compressor, so as to be adjacent to the front housing 19. Further, a swash plate chamber 33 is formed by the first cylinder block 21 and the second cylinder block 23. The swash plate chamber 33 is located approximately at the front-rear direction center of the housing 1.

In the first cylinder block 21, a plurality of first cylinder bores 21*a* are formed in parallel with each other at equal angular intervals in the circumferential direction. Further, a first shaft hole 21*b*, into which the drive shaft 3 is inserted, is formed in the first cylinder block 21. The first shaft hole 21*b* is made to communicate with the pressure regulation chamber 25. A first slide bearing 24*a* is provided in the first shaft hole 21*b*.

Further, a first storage chamber 21*c*, which is made to communicate with the first shaft hole 21*b* so as to be coaxial with the first shaft hole 21*b*, is formed to be recessed in the first cylinder block 21. The periphery of the first storage chamber 21*c* is surrounded by the wall surface as a part of the first cylinder block 21, so that the first storage chamber 21*c* is partitioned from the first cylinder bores 21*a*. The inside of the first storage chamber 21*c* is made to communicate with the swash plate chamber 33. Further, the first storage chamber 21*c* is formed to have a shape whose diameter is reduced stepwise toward the rear end. A first thrust bearing 35*a* is provided at the rear end of the first storage chamber 21*c*. Further, a first suction passage 37*a*, which makes the swash plate chamber 33 communicate with the first suction chamber 27*a*, is formed in the first cylinder block 21.

A plurality of second cylinder bores 23*a* is formed in the second cylinder block 23. Further, a second shaft hole 23*b*, into which the drive shaft 3 is inserted, is formed in the second cylinder block 23. A second slide bearing 24*b* is formed in the second shaft hole 23*b*.

Further, a second storage chamber 23*c*, which is made to communicate with the second shaft hole 23*b* so as to be coaxial with the second shaft hole 23*b*, is formed to be recessed in the second cylinder block 23. The periphery of the second storage chamber 23*c* is surrounded by the wall surface as a part of the second cylinder block 23, so that the second storage chamber 23*c* is partitioned from each of the second cylinder bores 23*a*. The second storage chamber 23*c* is also made to communicate with the swash plate chamber 33. The second storage chamber 23*c* is formed to have a shape whose diameter is reduced stepwise toward the front end. A second thrust bearing 35*b* is provided at the front end of the second storage chamber 23*c*. Further, a second suction passage 37*b*, through which the swash plate chamber 33 is made to communicate with the second suction chamber 27*b*, is formed in the second cylinder block 23.

Figure 3:
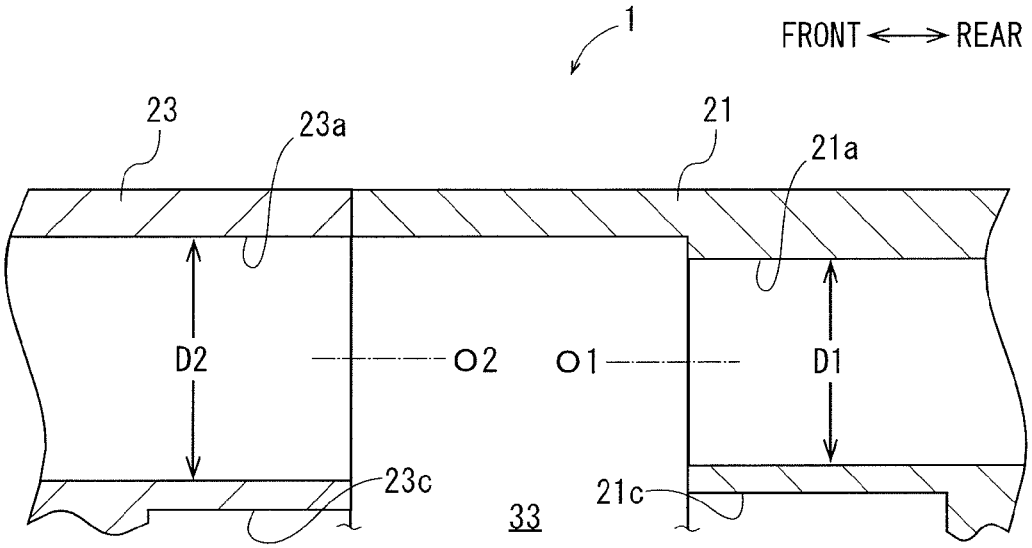
FIG. 3 is an enlarged sectional view of a main part of a first cylinder bore and a second cylinder bore according to the compressor of Embodiment 1.

As shown in FIG. 3, in this compressor, the diameter D1 of the first cylinder bores 21*a* is smaller than the diameter D2 of the second cylinder bores 23*a*. That is, in this compressor, each of the first cylinder bores 21*a* is formed to have a diameter smaller than the diameter of each of the second cylinder bores 23*a*. Thereby, as shown in FIG. 1, in this compressor, the first storage chamber 21*c* is configured to be larger than the second storage chamber 23*c*.

Further, as shown in FIG. 3, in this compressor, each of the first cylinder bores 21*a* is formed such that a first center line O1, which passes through the center of the first cylinder bore 21*a*, is located on the extension line of a second center line O2, which passes through the center of the corresponding second cylinder bore 23*a*. That is, in this compressor, each of the first cylinder bores 21*a* and each of the corresponding second cylinder bores 23*a* are formed to be coaxial with each other.

As shown in FIG. 1, the swash plate chamber 33 is connected to an evaporator (not shown) via an inlet port 330 formed in the first cylinder block 21.

A first valve plate 39 is provided between the rear housing 17 and the first cylinder block 21. Suction ports 39*a* and discharge ports 39*b*, the numbers of which are equal to the first cylinder bores 21*a*, are formed in the first valve plate 39. Further, suction reed valves 39*c* capable of opening and closing the respective suction ports 39*a* are provided in the first valve plate 39. Each of the first cylinder bores 21*a* is made to communicate with the first suction chamber 27*a* through the corresponding suction port 39*a* and the corresponding suction reed valve 39*c*. Retainer grooves 39*d*, which regulate the lift amount of the suction reed valves 39*c*, are formed in the respective first cylinder bores 21*a*. Further, discharge reed valves 39*e* capable of opening and closing the respective discharge ports 39*b* are provided in the first valve plate 39. Each of the first cylinder bores 21*a* is made to communicate with the first discharge chamber 29*a* through the corresponding discharge port 39*b* and the corresponding discharge reed valve 39*e*. Further, a retainer plate 39*f*, which regulates the lift amount of the discharge reed valves 39*e*, is provided in the first valve plate 39. Further, a communication hole 39*g*, through which the first suction chamber 27*a* is made communicate with the first suction passage 37*a*, is formed in the first valve plate 39.

A second valve plate 41 is provided between the front housing 19 and the second cylinder block 23. Suction ports 41*a* and discharge ports 41*b*, the numbers of which are equal to the second cylinder bores 23*a*, are formed in the second valve plate 41. Further, suction reed valves 41*c* capable of opening and closing the respective suction ports 41*a* are provided in the second valve plate 41. Each of the second cylinder bores 23*a* is made to communicate with the second suction chamber 27*b* through the corresponding suction port 41*a* and the corresponding suction reed valve 41*c*. Retainer grooves 41*d*, which regulate the lift amount of the suction reed valves 41*c*, are formed in the respective second cylinder bores 23*a*. Further, discharge reed valves 41*e* capable of opening and closing the respective discharge ports 41*b* are provided in the second valve plate 41. Each of the second cylinder bores 23*a* is made to communicate with the second discharge chamber 29*b* through the corresponding discharge port 41*b* and the corresponding discharge reed valve 41*e*. Further, a retainer plate 41*f*, which regulates the lift amount of the discharge reed valves 41*e*, is provided at the second valve plate 41. Further, communication holes 41*g*, through which the second suction chamber 27*b* are made to communicate with the second suction passage 37*b*, are formed in the second valve plate 41.

The first and second suction chambers 27*a* and 27*b* are made communicate with the swash plate chamber 33 by the first and second suction passages 37*a* and 37*b* and the communication holes 39*g* and 41*g*. For this reason, the pressure in the first and second suction chambers 27*a* and 27*b* is made substantially equal to the pressure in the swash plate chamber 33. Further, refrigerating gas, having passed through the evaporator, flows into the swash plate chamber 33 through the inlet port 330, and hence the pressure in the swash plate chamber 33 and in each of the first and second suction chambers 27*a* and 27*b* is lower than the pressure in the first and second discharge chambers 29*a* and 29*b*.

The swash plate 5 and the actuator 13 are attached to the drive shaft 3. Further, a first support member 42 is press-fitted to the rear end side of the drive shaft 3. A flange 42*a* is formed at the first support member 42. The drive shaft 3 is made to extend from the side of the boss 19*a* to the rear side, so as to be inserted into the first and second slide bearings 24*a* and 24*b*. Thereby, the drive shaft 3 is supported rotatably about the rotational axis O3. Further, the drive shaft 3 is inserted into the housing 1, and thereby the swash plate 5, the actuator 13, and the flange 42*a* are arranged in the swash plate chamber 33, respectively.

The second support member 43 is press-fitted to the front end side of the drive shaft 3. In the second support member 43, a flange 43*a*, which is brought into contact with the second thrust bearing 35*b*, is formed, and amounting section (not shown), in which a second pin 47*b* described below is inserted, is formed. Further, the front end of a first return spring 44*a* is fixed to the second support member 43. The first return spring 44*a* is extended in the direction of the rotational axis O3 from the side of the support member 43 to the side of the swash plate chamber 33.

Further, a shaft passage 3*b* extending from a rear end toward a front end of the drive shaft 3 in the direction of the rotational axis O3, and a radial passage 3*c* extending from the front end of the shaft passage 3*b* in the radial direction of the drive shaft 3 so as to be open in the outer circumference surface of the drive shaft 3 are formed in the drive shaft 3. The rear end of the shaft passage 3*b* is open to the pressure regulation chamber 25. The radial passage 3*c* is open to a control pressure chamber 13*c* described below.

A screw section 3*d* is formed at the tip end of the drive shaft 3. The drive shaft 3 is connected to a pulley or electromagnetic clutch (not shown) via the screw section 3*d*. A belt (not shown), which is driven by an engine of a vehicle, is wound around the pulley or the electromagnetic clutch.

The swash plate 5 is formed in an annular flat plate shape and has a rear surface 5*a* and a front surface 5*b*. The rear surface 5*a* faces the side of the first cylinder bores 21*a* in the swash plate chamber 33, that is, the rear side of the compressor. The side of the rear surface 5*a* of the swash plate 5 corresponds to the one end side in the present invention. The front surface 5*b* faces the side of the second cylinder bores 23*a* in the swash plate chamber 33, that is, the front side of the compressor. The side of the front surface 5*b* of the swash plate 5 corresponds to the other end side in the present invention.

The swash plate 5 is fixed to a ring plate 45. The ring plate 45 is formed in an annular flat plate shape, and an insertion hole 45*a* is formed in the center portion of the ring plate 45. The drive shaft 3 is inserted into the insertion hole 45*a* in the swash plate chamber 33 so that the swash plate 5 is attached to the drive shaft 3.

Figure 4:
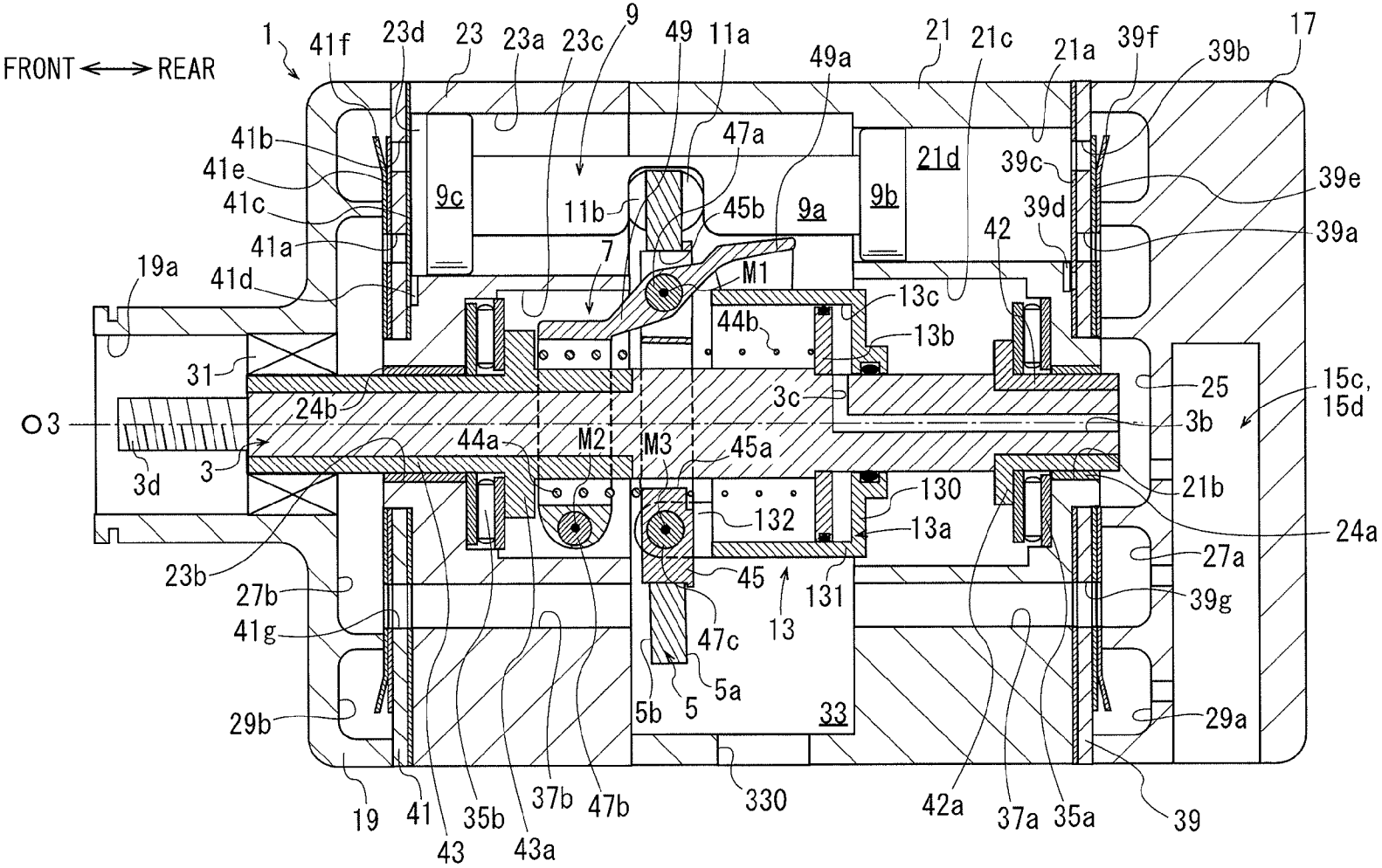
FIG. 4 is a cross-sectional view at the time of minimum capacity in the compressor of Embodiment 1.

The link mechanism 7 has a lug arm 49. The lug arm 49 is arranged on the front side with respect to the swash plate 5 in the swash plate chamber 33 and is located between the swash plate 5 and the second support member 43. The lug arm 49 is formed in a substantially L-shape extending from the front end side toward the rear end side. As shown in FIG. 4, the lug arm 49 is configured to be in contact with the flange 43*a* of the second support member 43 at the time when the inclination angle of the swash plate 5 with respect to the direction perpendicular to the rotational axis O3 is minimized. For this reason, in the compressor, the inclination angle of the swash plate 5 can be maintained at a minimum value by the lug arm 49. Further, a weight section 49*a* is formed on the rear end side of the lug arm 49. The weight section 49*a* extends over about half the circumference of the actuator 13 in the circumferential direction of the actuator 13. It should be noted that the shape of the weight section 49*a* can be suitably designed.

The rear end side of the lug arm 49 is connected to the one end side of the ring plate 45 by a first pin 47*a*. Thereby, the rear end side of the lug arm 49 is supported by using the shaft center of the first pin 47*a* as a first pivotal axis M1 , and supported pivotably around the first pivotal axis M1 with respect to the one end side of the ring plate 45, that is, the swash plate 5. The first pivotal axis M1 extends in the direction perpendicular to the rotational axis O3 of the drive shaft 3.

The front end side of the lug arm 49 is connected to the second support member 43 by the second pin 47*b*. Thereby, the front end side of the lug arm 49 is supported by using the shaft center of the second pin 47*b* as a second pivotal axis M2, and supported pivotably around the second pivotal axis M2 with respect to the second support member 43, that is, the drive shaft 3. The second pivotal axis M2 extends in parallel with the first pivotal axis M1. The lug arm 49 and the first and second pins 47*a* and 47*b* correspond to the link mechanism 7 in the present invention.

The weight section 49*a* is provided to extend to the rear end side of the lug arm 49, that is, to extend to the side opposite to the second pivotal axis M2 with respect to the first pivotal axis M1. Therefore, in the state in which the lug arm 49 is supported at the ring plate 45 by the first pin 47*a*, the weight section 49*a* is made to pass through a groove section 45*b* of the ring plate 45, so as to be located on the side of the rear surface of the ring plate 45, that is, on the side of the rear surface 5*a* of the swash plate 5. Thereby, the centrifugal force, generated at the time when the swash plate 5 is rotated around the rotational axis O3, is also made to act on the weight section 49*a* on the side of the rear surface 5*a* of the swash plate 5.

In this compressor, the swash plate 5 and the drive shaft 3 are connected to the link mechanism 7, and thereby the swash plate 5 can be rotated together with the drive shaft 3. Here, in this compressor, the arrangement position of the link mechanism 7 is determined so that, when the inclination angle of the swash plate 5 is minimized, the swash plate 5 connected to the link mechanism 7 is located at a position close to the side of the second cylinder bores 23*a* in the swash plate chamber 33. Further, the swash plate 5 is configured so that the inclination angle thereof can be changed at the time when the both ends of the lug arm 49 are pivoted respectively around the first pivotal axis M1 and the second pivotal axis M2.

Figure 5:
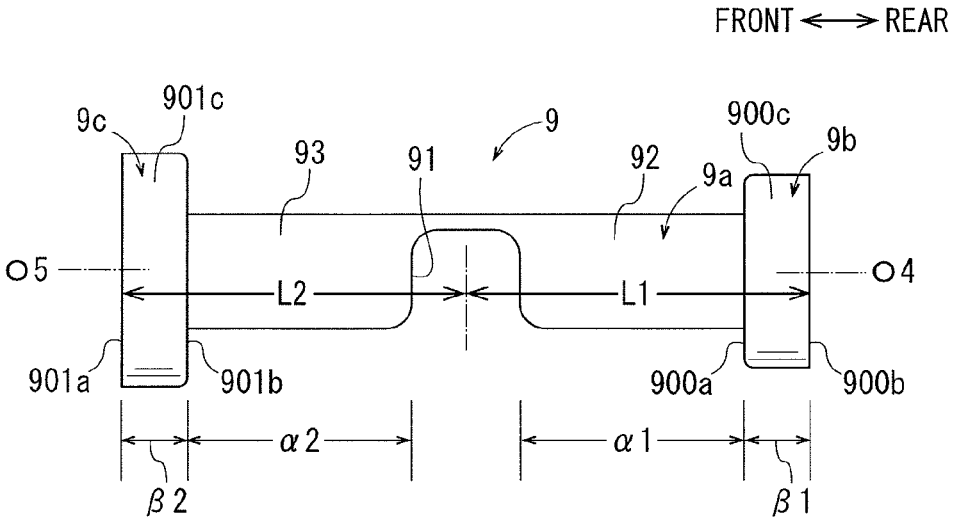
FIG. 5 is a side view showing a piston according to the compressor of Embodiment 1.

Each of the pistons 9 has a piston main body 9*a*, a first head section 9*b* formed at the rear end of the piston main body 9*a*, and a second head section 9*c* formed at the front end of the piston main body 9*a*. As shown in FIG. 5, the first head section 9*b* is formed in a substantially columnar shape and includes a first front end surface 900*a*, a first rear end surface 900*b*, and a first cylindrical surface 900*c* located between the first front end surface 900*a* and the first rear end surface 900*b*. Further, the second head section 9*c* is also formed in a substantially columnar shape and includes a second front end surface 901*a*, a second rear end surface 901*b*, and a second cylindrical surface 901*c* located between the second front end surface 901*a* and the second rear end surface 901*b*. The first head section 9*b* is connected to the piston main body 9*a* at the first front end surface 900*a*. The second head section 9*c* is connected to the piston main body 9*a* at the second rear end surface 901*b*. Here, in each of the pistons 9, a center line O4 passing through the center of the first head section 9*b* is located on the extension line of a center line O5 passing through the center of the second head section 9*c*. That is, each of the pistons 9 is formed such that the first head section 9*b* and the second head section 9*c* are coaxial with the piston main body 9*a*.

As shown in FIG. 1, each of the first head sections 9*b* is accommodated in each of the first cylinder bores 21*a* so as to be able to reciprocate in each of the first cylinder bores 21*a*. The inside of the first cylinder bores 21*a* is partitioned by the respective first head sections 9*b*, so that a first compression chamber 21*d* is formed in each of the first cylinder bores 21*a*. Each of the second head sections 9*c* is accommodated in each of the second cylinder bores 23*a* so as to be able to reciprocate in each of the second cylinder bores 23*a*. The inside of the second cylinder bores 23*a* is partitioned by the respective second head sections 9*c*, so that a second compression chamber 23*d* is formed in each of the second cylinder bores 23*a*.

As shown in FIG. 5, in each of the pistons, the piston main body 9*a* is configured by an engagement section 91 provided to be recessed at the longitudinal center of the piston main body 9*a*, a first neck section 92 extending from the engagement section 91 toward the side of the first head section 9*b*, and a second neck section 93 extending from the engagement section 91 toward the side of the second head section 9*c*. The first neck section 92 and the second neck section 93 are formed so that the length $\alpha 1$ of the first neck section 92 in the axial direction of the piston 9 (hereinafter referred to as the length $\alpha 1$ of the first neck section 92) is equal to the length $\alpha 2$ of the second neck section 93 in the axial direction of the piston 9 (hereinafter referred to as the length $\alpha 2$ of the second neck section 93).

Further, as described above, each of the first cylinder bores 21*a* is formed to be smaller in diameter than each of the second cylinder bores 23*a*, and hence the diameter of the first head section 9*b* is smaller than the diameter of the second head section 9*c*. That is, the first head section 9*b* is formed to be smaller in diameter than the second head section 9*c*. Here, the first head section 9*b* and the second head section 9*c* are formed to have the same length in the front and rear direction. Thereby, the length $\beta 1$ of the first cylindrical surface 900*c* in the axial direction of the piston 9 (hereinafter referred to as the length $\beta 1$ of the first cylindrical surface 900*c*) is equal to the length $\beta 2$ of the second cylindrical surface 901*c* in the axial direction of the piston 9 (hereinafter referred to as the length $\beta 2$ of the second cylindrical surface 901*c*). For this reason, in each of the pistons 9, the sum of the length $\alpha 1$ of the first neck section 92 and the length $\beta 1$ of the first cylindrical surface 900*c* is equal to the sum of the length $\alpha 2$ of the second neck section 93 and the length $\beta 2$ of the second cylindrical surface 901*c*. In this way, in each of the pistons 9, the distance L1 from the center of the engagement section 91 to the tip end of the first head section 9*b* is equal to the distance L2 from the center of the engagement section 91 to the tip end of the second head section 9*c*.

As shown in FIG. 1, the hemispherical shoes 11*a* and 11*b* are provided in each of the engagement sections 91. The rotation of the swash plate 5 is converted to the reciprocating movement of the pistons 9 by the shoes 11*a* and 11*b*. The shoes 11*a* and 11*b* correspond to the conversion mechanism in the present invention. In this way, each of the first and second head sections 9*b* and 9*c* can reciprocate in the inside of each of the first and second cylinder bores 21*a* and 23*a* at a stroke corresponding to the inclination angle of the swash plate 5.

Here, as described above, the swash plate 5 is located on the side of the second cylinder bores 23*a* in the swash plate chamber 33. Thereby, in this compressor, as shown in FIG. 1, when the inclination angle of the swash plate 5 is maximized so as to maximize the strokes of the pistons 9, the top dead center position of the first head section 9*b* is set at a position closest to the first valve plate 39, and the top dead center position of the second head section 9*c* is set at a position closest to the second valve plate 41. As shown in FIG. 4, as the inclination angle of the swash plate 5 is reduced to reduce the strokes of the pistons 9, the top dead center position of the first head section 9*b* is gradually displaced away from the first valve plate 39. The top dead center position of the second head section 9*c* is not almost changed from the position at the time of the maximum strokes of the pistons 9, and is maintained at the position close to the second valve plate 41.

As shown in FIG. 1, the actuator 13 is arranged in the swash plate chamber 33 and is located on the side of the first cylinder bores 21*a* with respect to the swash plate 5. The actuator 13 is configured such that a part thereof can enter the first storage chamber 21*c* so as to be accommodated in the first storage chamber 21*c*.

The actuator 13 includes a movable body 13*a*, a fixed body 13*b*, and the control pressure chamber 13*c*. The actuator main body in the present invention is formed by the movable body 13*a* and the fixed body 13*b*. The control pressure chamber 13*c* is formed between the movable body 13*a* and the fixed body 13*b*.

The movable body 13*a* includes a main body section 130 and a peripheral wall 131. The main body section 130 is located on the rear side of the movable body 13*a* and is extended in the radial direction away from the rotational axis O3. The peripheral wall 131 is made continuous with the outer peripheral edge of the main body section 130 and is extended from the rear side toward the front side. Further, a connection section 132 is formed at the front end of the peripheral wall 131. The movable body 13*a* has a bottomed cylindrical shape formed by the main body sections 130, the peripheral wall 131, and the connection section 132.

The fixed body 13*b* is formed in a disc shape having a diameter substantially the same as the inner diameter of the movable body 13*a*. A second return spring 44*b* is provided between the fixed body 13*b* and the ring plate 45. Specifically, the rear end of the second return spring 44*b* is fixed to the fixed body 13*b*. The front end of the second return spring 44*b* is fixed to the other end side of the ring plate 45.

The drive shaft 3 is inserted into the movable body 13*a* and the fixed body 13*b*. Thereby, the movable body 13*a* is arranged in a state of being accommodated in the first storage chamber 21*c* and facing the link mechanism 7 via the swash plate 5. The fixed body 13*b* is arranged in the movable body 13*a* and on the rear side of the swash plate 5, so that the periphery of the fixed body 13*b* is surrounded by the peripheral wall 131. Thereby, the control pressure chamber 13*c* is formed between the movable body 13*a* and the fixed body 13*b*. The control pressure chamber 13*c* is partitioned from the swash plate chamber 33 by the main body section 130 and the peripheral wall 131 of the movable body 13*a*, and the fixed body 13*b*. As described above, the radial passage 3*c* is opened in the control pressure chamber 13*c*, and the control pressure chamber 13*c* is made to communicate with the pressure regulation chamber 25 through the radial passage 3*c* and the shaft passage 3*b*.

The other end side of the ring plate 45 is connected to the connection section 132 of the movable body 13*a* by a third pin 47*c*. Thereby, the other end side of the ring plate 45, that is, the swash plate 5 is supported by the movable body 13*a* so as to be pivotable around an action axis M3 by using the shaft center of the third pin 47*c* as the action axis M3. The action axis M3 extends in parallel with the first and second pivotal axes M1 and M2. In this way, the movable body 13*a* is in a state of being connected to the swash plate 5. Further, it is configured such that the movable body 13*a* is brought into contact with the flange 42*a* of the first support member 42 at the time when the inclination angle of the swash plate 5 is maximized.

Further, the drive shaft 3 is inserted into the movable body 13*a* so that the movable body 13*a* can be rotated together with the drive shaft 3 and can be moved in the direction of the rotational axis O3 of the drive shaft 3 in the swash plate chamber 33. The fixed body 13*b* is fixed to the drive shaft 3 in a state in which the drive shaft 3 is inserted into the fixed body 13*b*. Therefore, the fixed body 13*b* can be only rotated together with the drive shaft 3, and it is impossible that the fixed body 13*b* is moved similarly to the movable body 13*a*. Thereby, when the movable body 13*a* is moved in the direction of the rotational axis O3, the movable body 13*a* is moved relative to the fixed body 13*b*.

As shown in FIG. 2, the control mechanism 15 includes a release passage 15*a*, a supply passage 15*b*, a control valve 15*c*, and an orifice 15*d*.

The release passage 15*a* is connected to the pressure regulation chamber 25 and the first suction chamber 27*a*. Thereby, the control pressure chamber 13*c*, the pressure regulation chamber 25, and the first suction chamber 27*a* are made to communicate with each other by the release passage 15*a*, the shaft passage 3*b*, and the radial passage 3*c*. The supply passage 15*b* is connected to the pressure regulation chamber 25 and the first discharge chamber 29*a*. The control pressure chamber 13*c*, the pressure regulation chamber 25, and the first discharge chamber 29*a* are made to communicate with each other by the supply passage 15*b*, the shaft passage 3*b*, and the radial passage 3*c*. Further, the orifice 15*d* is provided in the supply passage 15*b*, so as to regulate the flow rate of refrigerating gas flowing through the supply passage 15*b*.

The control valve 15*c* is provided at the release passage 15*a*. The control valve 15*c* is configured to adjust the opening degree of the release passage 15*a* on the basis of the pressure in the first suction chamber 27*a*. Thereby, the control valve 15*c* is configured to be able to adjust the flow rate of refrigerating gas flowing through the release passage 15*a*.

In this compressor, a pipe connected to an evaporator is connected to the inlet port 330 shown in FIG. 1, and a pipe connected to a condenser is connected to the outlet port. The condenser is connected to the evaporator via a pipe and an expansion valve. The refrigeration circuit of a vehicle air conditioner is configured by the compressor, the evaporator, the expansion valve, the condenser, and the like. It should be noted that the evaporator, the expansion valve, the condenser, and each of the pipes are not shown.

In the compressor configured as described above, when the drive shaft 3 is rotated, the swash plate 5 is rotated to reciprocate each of the pistons 9 in the first and second cylinder bores 21*a* and 23*a*. For this reason, the capacity of each of the first and second compression chambers 21*d* and 23*d* is changed according to the piston strokes. Therefore, the refrigerating gas sucked from the evaporator into the swash plate chamber 33 through the inlet port 330 is compressed in the first and second compression chambers 21*d* and 23*d* after passing through the first and second suction chambers 27*a* and 27*b*, and is then discharged into the first and second discharge chambers 29*a* and 29*b*. The refrigerating gas in the first and second discharge chamber 29*a* and 29*b* is discharged into the condenser through the outlet port.

During this period, in this compressor, piston compression force for reducing the inclination angle of the swash plate 5 acts on the rotating body configured by the swash plate 5, the ring plate 45, the lug arm 49, and the first pin 47*a*. Then, when the inclination angle of the swash plate 5 is changed, it is possible to perform the capacity control by the change in the strokes of the pistons 9.

Specifically, in the control mechanism 15, when the flow rate of refrigerating gas flowing through the release passage 15*a* is increased by the control valve 15*c* shown in FIG. 2, it becomes difficult that the refrigerating gas in the first discharge chamber 29*a* is stored in the pressure regulation chamber 25 through the supply passage 15*b* and the orifice 15*d*. For this reason, the pressure of the control pressure chamber 13*c* becomes almost equal to the pressure of the first suction chamber 27*a*. Therefore, as shown in FIG. 4, the actuator 13 is displaced by the piston compression force acting on the swash plate 5, so that the movable body 13*a* is moved toward the front side of the swash plate chamber 33, that is, toward the outside of the first storage chamber 21*c*, so as to become close to the lug arm 49.

Thereby, in this compressor, the other end side of the ring plate 45, that is, the other end side of the swash plate 5 is pivoted around the action axis M3 in the clockwise direction against the urging force of the second return spring 44*b*. Further, the rear end of the lug arm 49 is pivoted around the first pivotal axis M1 in the counter clockwise direction, and the front end of lug arm 49 is pivoted around the second pivotal axis M2 in the counter clockwise direction. As a result, the lug arm 49 is brought close to the flange 43*a* of the second support member 43. Thereby, the swash plate 5 is pivoted by using the action axis M3 as an action point, and by using the first pivotal axis M1 as a fulcrum. As a result, the inclination angle of the swash plate 5 with respect to the direction perpendicular to the rotational axis O3 of the drive shaft 3 becomes close to 0 degree, so that the strokes of the pistons 9 are reduced. Thereby, in this compressor, the suction and discharge volume per one revolution is reduced. It should be noted that the inclination angle of the swash plate 5 shown in FIG. 4 is a minimum inclination angle in this compressor.

Here, in this compressor, the centrifugal force acting on the weight section 49*a* is also applied to the swash plate 5. For this reason, in this compressor, the swash plate 5 is easily displaced in the direction in which the inclination angle is reduced. Further, the movable body 13*a* is moved to the front side of the swash plate chamber 33, so that the front end of the movable body 13*a* is located inside the weight section 49*a*. Thereby, in this compressor, when the inclination angle of the swash plate 5 is reduced, the movable body 13*a* is brought in a state in which about half of the front end side of the movable body 13*a* is covered by the weight section 49*a*.

Further, when the inclination angle of the swash plate 5 is reduced, the ring plate 45 is brought into contact with the rear end of the first return spring 44*a*. Thereby, the first return spring 44*a* is elastically deformed, and is compressed by the ring plate 45.

Then, as described above, in this compressor, when the inclination angle of the swash plate 5 is reduced to reduce the strokes of the pistons 9, the top dead center position of the first head section 9*b* is located away from the first valve plate 39. Thereby, in this compressor, when the inclination angle of the swash plate 5 is brought close to 0 degree, slight compression work is performed on the side of the second compression chambers 23*d*, and no compression work is performed on the side of the first compression chambers 21*d*.

When the flow rate of refrigerating gas flowing through the release passage 15*a* is reduced by the control valve 15*c* shown in FIG. 2, the refrigerating gas in the first discharge chamber 29*a* is easily stored in the pressure regulation chamber 25 through the supply passage 15*b* and the orifice 15*d*. Thereby, the pressure of the control pressure chamber 13*c* becomes almost equal to the pressure of the first discharge chamber 29*a*. As a result, the actuator 13 is displaced against the piston compression force acting on the swash plate 5, so that, as shown in FIG. 1, the movable body 13*a* is moved toward the rear side of the swash plate chamber 33, that is, toward the inside of the first storage chamber 21*c*, so as to be located away from the lug arm 49.

As a result, in this compressor, the other end side of the swash plate 5 is in a state of being pulled at the action axis M3 toward the rear side of the swash plate chamber 33 by the movable body 13*a* via the connection section 132. Thereby, the other end side of the swash plate 5 is pivoted around the action axis M3 in the counter clockwise direction. Further, the rear end of the lug arm 49 is pivoted around the first pivotal axis M1 in the clockwise direction, and the front end of the lug arm 49 is pivoted around the second pivotal axis M2 in the clockwise direction. Thereby, the lug arm 49 is separated from the flange 43*a* of the second support member 43. As a result, by respectively using the action axis M3 and the first pivotal axis M1 as an action point and a fulcrum, the swash plate 5 is pivoted in the direction opposite to the direction in the above-described case where the inclination angle is reduced. For this reason, the inclination angle of the swash plate 5 with respect to the direction perpendicular to the rotational axis O3 of the drive shaft 3 is increased. Thereby, in this compressor, the strokes of the pistons 9 are increased, so that the suction and discharge volume per one revolution of the compressor is increased. It should be noted that the inclination angle of the swash plate 5 shown in FIG. 1 is a maximum inclination angle in this compressor.

In this compressor, each of the first cylinder bores 21*a* is formed to be smaller in diameter than each of the second cylinder bores 23*a*, and also, in each of the pistons 9, the first head section 9*b* is formed to be smaller in diameter than the second head section 9*c*. Therefore, as shown in FIG. 3, in this compressor, without increasing the size of the first cylinder block 21, the first storage chamber 21*c* can be formed to be larger than the second storage chamber 23*c* in correspondence with the amount by which the diameter of the first cylinder bores 21*a* is smaller than the diameter of the second cylinder bores 23*a*, that is, in correspondence with the difference between the diameter D2 of the second cylinder bores 23*a* and the diameter D1 of the first cylinder bores 21*a*.

Therefore, as shown in FIG. 1, in this compressor, the size of the control pressure chamber 13*c* can be increased by increasing the size of the movable body 13*a* and the fixed body 13*b*. Thereby, in this compressor, the size of the control pressure chamber 13*c* is increased, so that the movable body 13*a* can be moved by a large thrust force. As a result, in this compressor, the compression capacity can be rapidly increased or reduced in a configuration in which the size of the compressor is prevented from being increased.

Further, in this compressor, as shown in FIG. 4, when the inclination angle of the swash plate 5 becomes close to 0 degree, slight compression work is performed in the second compression chambers 23*d*, and no compression work is performed in the first compression chambers 21*d*. For this reason, in this compressor, even when each of the first cylinder bores 21*a* and the first head section 9*b* is reduced in diameter, desired compression capacity can be secured on the side of the second compression chambers 23*d*.

Therefore, the compressor of Embodiment 1 has high controllability, and also can exhibit high mounting performance and secure sufficient compression capacity.

In particular, in this compressor, the first and second cylinder blocks 21 and 23 are formed so that each of the first cylinder bores 21*a* and each of the second cylinder bores 23*a* are coaxial with each other. Therefore, in this compressor, each of the first cylinder bores 21*a* can be easily formed in the first cylinder block 21, and also each of the second cylinder bores 23*a* can be easily formed in the second cylinder block 23. Further, in this compressor, the first head section 9*b* and the second head section 9*c* are arranged coaxially with each other in each of the pistons 9, and hence the pistons 9 can also be easily formed.

Further, as shown in FIG. 5, in this compressor, the front-rear direction length of the first head section 9*b* is set to be equal to the front-rear direction length of the second head section 9*c*, so that the length $\beta 1$ of the first cylindrical surface 900*c* is set to be equal to the length $\beta 2$ of the second cylindrical surface 901*c* for each of the pistons 9. Further, in this compressor, the length $\alpha 1$ of the first neck section 92 is also set to be equal to the length $\alpha 2$ of the second neck section 93 for each of the pistons 9. With this configuration, in this compressor, the distance L1 from the center of the engagement section 91 to the tip end of the first head section 9*b* and the distance L2 from the center of the engagement section 91 to the tip end of the second head section 9*c* are set to be equal to each other for each of the pistons 9. Thereby, in this compressor, the piston main body 9*a*, and the first and second head sections 9*b* and 9*c* are easily formed, so that each of the pistons 9 can be easily formed.

[Embodiment 2]

Figure 6:
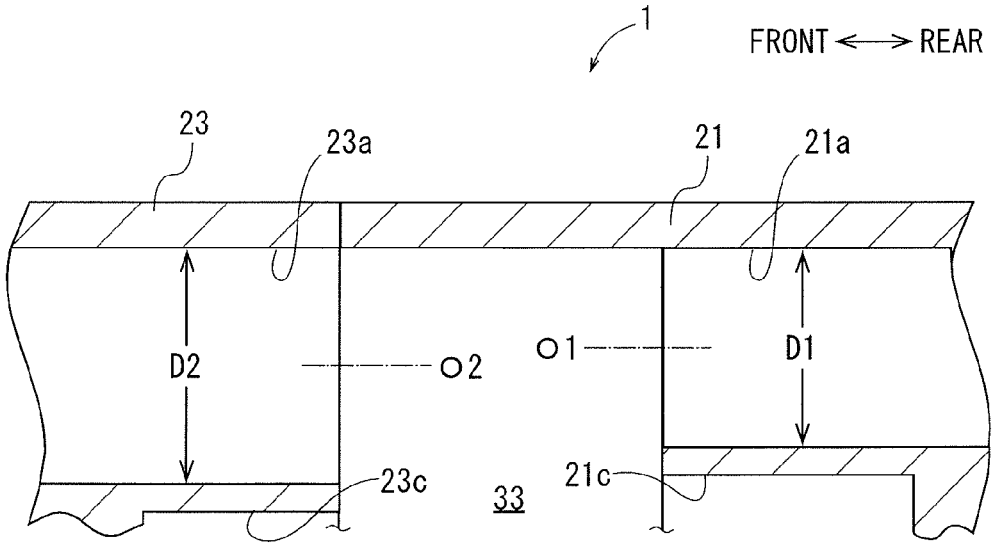
FIG. 6 is an enlarged sectional view of a main part of a first cylinder bore and a second cylinder bore according to a compressor of Embodiment 2.

As shown in FIG. 6, in a compressor of Embodiment 2, each of the first cylinder bores 21*a* is formed at a position closer to the radially outer side of the first cylinder block 21 as compared with the compressor of Embodiment 1. Thereby, in this compressor, the position of the first center line O1 of each of the first cylinder bores 21*a* is different from the position of the second center line O2 of each of the second cylinder bores 23*a*. That is, in this compressor, each of the first cylinder bores 21*a* and each of the second cylinder bores 23*a* are formed non-coaxially with each other.

Figure 7:
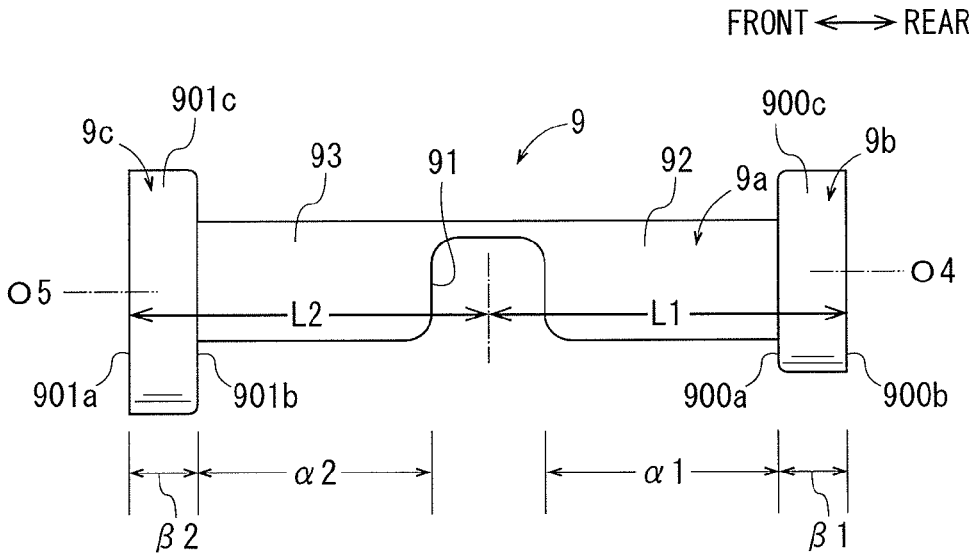
FIG. 7 is a side view showing a piston according to the compressor of Embodiment 2.

Further, in each of the pistons 9, when the first cylinder bore 21*a* is not coaxial with the second cylinder bore 23*a*, the position of the center line O4 of the first head section 9*b* is different from the position of the center line O5 of the second head section 9*c* as shown in FIG. 7. That is, in each of the pistons 9, the first head section 9*b* and the second head section 9*c* are formed in the piston main body 9*a* non-coaxially with each other. The other configurations of this compressor are the same as the configurations of the compressor of Embodiment 1, and the same configurations are denoted by the same reference numerals and characters, and the detailed description thereof is omitted.

In this compressor, since each of the first cylinder bores 21*a* and each of the second cylinder bores 23*a* are formed non-coaxially with each other, the degree of freedom in design related to the position of each of the first cylinder bores 21*a* in the first cylinder block 21 can be enhanced. Further, in this compressor, since each of the first cylinder bores 21*a* is formed at a position close to the radially outer side of the first cylinder block 21, the first storage chamber 21*c* in the first cylinder block 21 can be formed in a larger size as compared with the compressor of Embodiment 1.

For this reason, in this compressor, the movable body 13*a* and the fixed body 13*b* are formed in a larger size, so that the size of the control pressure chamber 13*c* can be further increased. As a result, in this compressor, the movable body 13*a* can be moved by a larger thrust force, and thereby the compression capacity can be rapidly increased or reduced in a configuration in which the size of the compressor is prevented from being increased. The other effects of this compressor are the same as those of the compressor of Embodiment 1.

[Embodiment 3]

Figure 8:
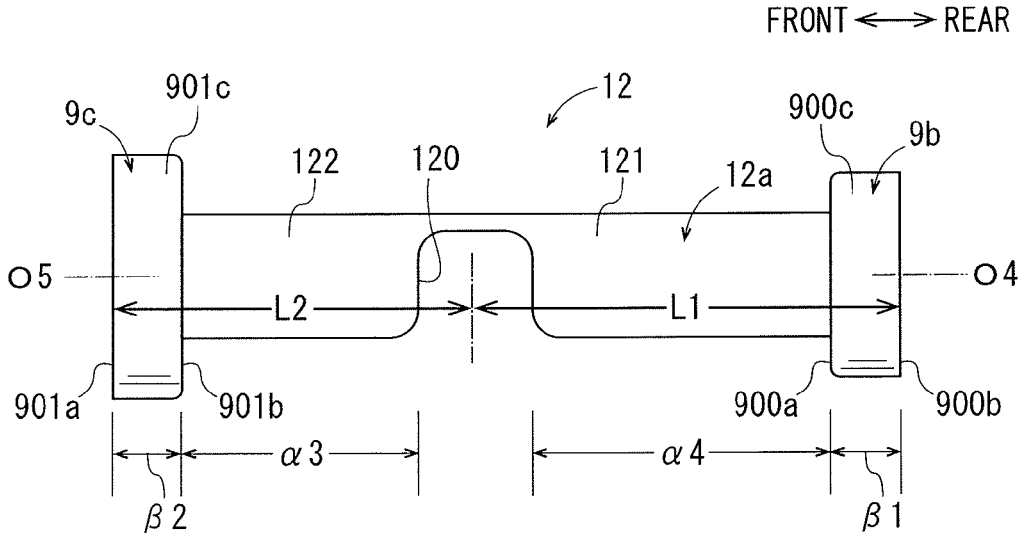
FIG. 8 is a side view showing a piston according to a compressor of Embodiment 3.

A compressor of Embodiment 3 comprises a plurality of pistons 12 shown in FIG. 8 instead of the pistons 9 in the compressor of Embodiment 1. Each of the pistons 12 has a piston main body 12*a*, and also has the first head section 9*b* and the second head section 9*c* similarly to the compressor of Embodiment 1. It should be noted that, as for the length β1 of the first cylindrical surface 900*c*, and the length β2 of the second cylindrical surface 901*c*, the axial direction of the piston 9 is set as the axial direction of the piston 12 in the present embodiment.

In each of the pistons 12, the first head section 9*b* is connected to the piston main body 12*a* at the first front end surface 900*a*. Thereby, the first head section 9*b* is located at the rear end of the piston main body 12*a*, so as to be able to reciprocate in each of the first cylinder bores 21*a*. Further, the second head section 9*c* is connected to the piston main body 12*a* at the second rear end surface 901*b*. Thereby, the second head section 9*c* is located at the front end of the piston main body 12*a*, so as to be able to reciprocate in each of the second cylinder bores 23*a*. Further, each of the pistons 12 is also configured such that the centerline O4 passing through the center of the first head section 9*b* is located on the extension line of the center line O5 passing through the center of the second head section 9*c*, and such that the first head section 9*b* and the second head section 9*c* are coaxial with respect to the piston main body 12*a*.

In each of the pistons 12, the piston main body 12*a* is configured by an engagement section 120, a first neck section 121 extending from the engagement section 120 toward the first head section 9*b*, and a second neck section 122 extending from the engagement section 120 toward the side of the second head section 9*c*. Here, the piston main body 12*a* is formed so that the length α3 of the second neck section 122 in the axial direction of the piston 12 (hereinafter referred to as the length α3 of the second neck section 122) is equal to the length α2 of the second neck section 93 in the piston 9. The piston main body 12*a* is formed so that the length α4 of the first neck section 121 in the axial direction of the piston 12 (hereinafter referred to as the length α4 of the first neck section 121) is longer than the length α3 of the second neck section 122. Therefore, in each of the pistons 12, the value of the sum of the length α4 of the first neck section 121 and the length β1 of the first cylindrical surface 900*c* is larger than the value of the sum of the length α3 of the second neck section 122 and the length β2 of the second cylindrical surface 901*c*. As a result, in each of the pistons 12, the distance L1 from the center of the engagement section 120 to the tip end of the first head section 9*b* is larger than the distance L2 from the center of the engagement section 120 to the tip end of the second head section 9*c*.

As described above, in each of the pistons 12, the distance L1 from the center of the engagement section 120 to the tip end of the first head section 9*b* is larger than the distance L2 from the center of the engagement section 120 to the tip end of the second head section 9*c*. Thereby, although not shown, in this compressor, the first cylinder block 21 is formed to be longer in the front and rear direction as compared with the compressor of Embodiment 1. Thereby, in this compressor, each of the first cylinder bores 21*a* is formed to be long in the front and rear direction. The other configurations of this compressor are the same as those of the compressor of Embodiment 1.

In this way, in this compressor, the length α4 of the first neck section 121 is longer than the length α3 of the second neck section 122, and thereby, in each of the pistons 12, the distance L1 from the center of the engagement section 120 to the tip end of the first head section 9*b* is longer than the distance L2 from the center of the engagement section 120 to the tip end of the second head section 9*c*. For this reason, in this compressor, even in a case where the diameter of the first head section 9*b* is made smaller than the diameter of the second head section 9*c*, the weight on the side of the first head section 9*b* can be easily made larger than the weight on the side of the second head section 9*c* in each of the pistons 12, and hence the weight on the side of the first head section 9*b* and the weight on the side of the second head section 9*c* can be easily balanced in each of the pistons 12. In this way, in this compressor, each of the pistons 12 can be made to suitably reciprocate in each pair of the first and second cylinder bores 21*a* and 23*a*. The other effects of the compressor are the same as those of the compressor of Embodiment 1.

[Embodiment 4]

Figure 9:
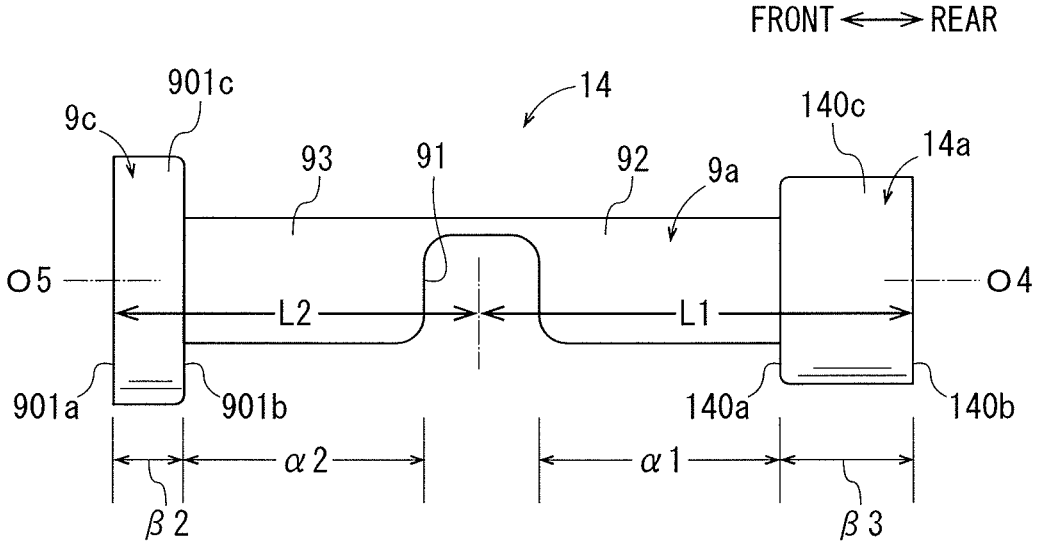
FIG. 9 is a side view showing a piston according to a compressor of Embodiment 4.

A compressor of Embodiment 4 includes a plurality of pistons 14 shown in FIG. 9 instead of each of the pistons 9 in the compressor of Embodiment 1. Similarly to the compressor of Embodiment 1, each of the pistons 14 includes the piston main body 9*a* and the second head section 9*c*, and also includes a first head section 14*a*. The first head section 14*a* is also formed in a substantially columnar shape and includes a first front end surface 140*a*, a first rear end surface 140*b*, and a first cylindrical surface 140*c*. The first head section 14*a* is formed to have a diameter smaller than the diameter of the second head section 9*c*.

In each of the pistons 14, the first head section 14*a* is connected to the piston main body 9*a* at the first front end surface 140*a*. Thereby, the first head section 14*a* is located at the rear end of the piston main body 9*a*, so as to be able to reciprocate in each of the first cylinder bores 21*a*. Further, the second head section 9*c* is connected to the piston main body 9*a* at the second rear end surface 901*b*. Thereby, the second head section 9*c* is located at the front end of the piston main body 9*a*, so as to be able to reciprocate in each of the second cylinder bores 23*a*. Further, each of the pistons 14 is also configured such that the center line O4 passing through the center of the first head section 14*a* is located on the extension line of the center line O5 passing through the center of the second head section 9*c*, and such that the first head section 14*a* and the second head section 9*c* are coaxial with respect to the piston main body 9*a*.

Here, the first head section 14*a* is formed to be longer in the front and rear direction than the second head section 9*c*. Therefore, the length β3 of the first cylindrical surface 140*c* in the axial direction of the piston 14 (hereinafter referred to as the length β3 of the first cylindrical surface 140*c*) is longer than the length β2 of the second head section 9*c* in the piston 14 of the compressor of Embodiment 4.

Thereby, in each of the pistons 14 (the axial direction of the piston 9 is set in the axial direction of the piston 14 in the present embodiment), the value of the sum of the length α1 of the first neck section 92 and the length β3 of the first cylindrical surface 140*c* is larger than the value of the sum of the length α2 of the second neck section 93 and the length β2 of the second cylindrical surface 901*c*. In this way, in each of the pistons 14, the distance L1 from the center of the engagement section 91 to the tip end of the first head section 14*a* is longer than the distance L2 from the center of the engagement section 91 to the tip end of the second head section 9*c*. It should be noted that, similarly to the compressor of Embodiment 3, the first cylinder block 21 is also formed to be long in the front and rear direction in this compressor, and hence each of the first cylinder bores 21*a* is formed to be long in the front and rear direction (not shown). The other configurations of this compressor are the same as those of the compressor of Embodiment 1.

In this way, in this compressor, in order that, in each of the pistons 14, the distance L1 from the center of the engagement section 91 to the tip end of the first head section 14*a* is made longer than the distance L2 from the center of the engagement section 91 to the tip end of the second head section 9*c*, the length β3 of the first cylindrical surface 140*c* is made longer than the length β2 of the second cylindrical surface 901*c*. This makes it possible that, in this compressor, even when the first head section 14*a* is formed to have a diameter smaller than the diameter of the second head section 9*c*, the weight on the side of the first head section 14*a* is easily made larger than the weight on the side of the second head section 9*c* in each of the pistons 14. Thereby, even in this compressor, the weight on the side of the first head section 14*a* and the weight on the side of the second head section 9*c* can be easily balanced in each of the pistons 14. The other effects of this compressor are the same as those of the compressor of Embodiment 1.

In the above, the present invention has been described by way of Embodiments 1 to 4. However, the present invention is not limited to Embodiments 1 to 4 described above, and it goes without saying that the present invention can be practiced with proper modification without departing from the scope of the present invention.

For example, in the piston 14 in the compressor of Embodiment 4, the length α1 of the first neck section 92 can be made smaller than the length α2 of the second neck section 93 so that the sum of the length α1 of the first neck section 92 and the length β3 of the first cylindrical surface 140*c* is equal to the sum of the length α2 of the second neck section 93 and the length β2 of the second cylindrical surface 901*c*. This makes it possible that, in each of the pistons 14, in a state in which the first head section 14*a* is formed to be longer in the front and rear direction than the second head section 9*c*, the distance L1 from the center of the engagement section 91 to the tip end of the first head section 14*a* is made equal to the distance L2 from the center of the engagement section 91 to the tip end of the second head section 9*c*.

Further, the control mechanism 15 may also be configured such that the control valve 15*c* is provided at the supply passage 15*b*, and such that the orifice 15*d* is provided at the release passage 15*a*. In this case, the flow rate of the high-pressure refrigerating gas flowing through the supply passage 15*c* can be adjusted by the control valve 15*c*. Thereby, the pressure in the control pressure chamber 13*c* can be rapidly increased by the high pressure in the first discharge chamber 29*a*, so that the compression capacity can be rapidly reduced.

The invention claimed is:

1. A variable displacement swash plate type compressor comprising:

a housing in which a suction chamber, a discharge chamber, a swash plate chamber, and a cylinder bore are formed; a drive shaft which is rotatably supported by the housing; a swash plate capable of rotating in the swash plate chamber by rotation of the drive shaft; a link mechanism which is provided between the drive shaft and the swash plate to allow a change of the inclination angle of the swash plate with respect to the direction perpendicular to the rotational axis of the drive shaft; a piston which is accommodated in the cylinder bore so as to be able to reciprocate in the cylinder bore; a conversion mechanism which reciprocates the piston in the cylinder bore by rotation of the swash plate and at a stroke corresponding to the inclination angle; an actuator capable of changing the inclination angle; and a control mechanism which controls the actuator, wherein the cylinder bore is configured by a first cylinder bore provided on one surface side of the swash plate, and a second cylinder bore provided on the other surface side of the swash plate, the piston includes a first head section being reciprocated in the first cylinder bore and partitioning a first compression chamber in the first cylinder bore, and a second head section being reciprocated in the second cylinder bore and partitioning a second compression chamber in the second cylinder bore, the link mechanism is arranged to allow the top dead center position of the first head section to be moved more than the top dead center position of the second head section according to a change of the inclination angle, the actuator is provided to be rotatable integrally with the drive shaft and is arranged on the side of the first cylinder bore with respect to the swash plate in the swash plate chamber, the actuator includes an actuator main body connected to the swash plate and configured to be movable in the rotational axis direction, and a control pressure chamber configured to move the actuator main body at the time when the internal pressure of the control pressure chamber is changed by the control mechanism, and the first cylinder bore is formed to have a diameter smaller than the diameter of the second cylinder bore.

2. The variable displacement swash plate type compressor according to claim 1, wherein the first cylinder bore and the second cylinder bore are arranged so as to be coaxial with each other.

3. The variable displacement swash plate type compressor according to claim 1, wherein the first cylinder bore and the second cylinder bore are arranged in a state in which the position of a first center line passing through the center of the first cylinder bore is different from the position of a second center line passing through the center of the second cylinder bore.

4. The variable displacement swash plate type compressor according to claim 1, wherein the piston includes an engagement section provided between the first head section and the second head section and engaging with the conversion mechanism, and the piston is configured such that the distance from the engagement section to the tip end of the first head section is longer than the distance from the engagement section to the tip end of the second head section.

5. The variable displacement swash plate type compressor according to claim 4, wherein the first head section has a first cylindrical surface fitted to the first cylinder bore, the second head section has a second cylindrical surface fitted to the second cylinder bore, and the length of the first cylindrical surface in the axial direction of the piston is equal to the length of the second cylindrical surface in the axial direction of the piston.

6. The variable displacement swash plate type compressor according to claim 5, wherein the first cylinder bore and the second cylinder bore are arranged so as to be coaxial with each other.

7. The variable displacement swash plate type compressor according to claim 1, wherein the first head section has a first cylindrical surface fitted to the first cylinder bore, the second head section has a second cylindrical surface fitted to the second cylinder bore, and the length of the first cylindrical surface in the axial direction of the piston is larger than the length of the second cylindrical surface in the axial direction of the piston.

8. The variable displacement swash plate type compressor according to claim 7, wherein the piston includes an engagement section provided between the first head section and the second head section and engaging with the conversion mechanism, and the piston is configured such that the distance from the engagement section to the tip end of the first head section is longer than the distance from the engagement section to the tip end of the second head section.

9. The variable displacement swash plate type compressor according to claim 8, wherein the first cylinder bore and the second cylinder bore are arranged so as to be coaxial with each other.

* * * * *